US008469361B2

(12) United States Patent
Gress

(10) Patent No.: US 8,469,361 B2
(45) **Date of Patent: *Jun. 25, 2013**

(54) ROLE-PLAYING GAME

(75) Inventor: Edmund Gress, Madison, CT (US)

(73) Assignee: Edmund Gress, Madison, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/452,793

(22) Filed: Apr. 20, 2012

(65) Prior Publication Data

US 2012/0208644 A1 Aug. 16, 2012

Related U.S. Application Data

(63) Continuation of application No. 12/717,382, filed on Mar. 4, 2010, now Pat. No. 8,181,963, which is a continuation of application No. 11/974,800, filed on Oct. 16, 2007, now abandoned.

(60) Provisional application No. 60/829,746, filed on Oct. 17, 2006.

(51) Int. Cl.
*A63F 1/00* (2006.01)
*A63F 9/24* (2006.01)

(52) U.S. Cl.
USPC ..... 273/292; 463/1; 463/43; 463/44; 273/243; 273/262; 273/308

(58) Field of Classification Search
USPC ..... 273/243, 262, 292–308; 463/1, 43, 463/44
See application file for complete search history.

(56) References Cited

U.S. PATENT DOCUMENTS

| | | | | |
|---|---|---|---|---|
| 3,167,313 | A | 1/1965 | Davenport et al. | 273/134 |
| 4,071,247 | A | 1/1978 | Breslow | 273/308 |
| 4,861,031 | A | 8/1989 | Simms | 273/999.999 |
| 5,071,688 | A | 12/1991 | Hoffman | 428/106 |

(Continued)

FOREIGN PATENT DOCUMENTS

| | | |
|---|---|---|
| DE | 2726550 A | 6/1979 |
| WO | WO 96/04968 | 2/1996 |

OTHER PUBLICATIONS

Int'l Search Report/Written Opinion mailed May 25, 2005 in Int'l Application No. PCT/US04/21790.

(Continued)

*Primary Examiner* — Dmitry Suhol
*Assistant Examiner* — Jason Skaarup
(74) *Attorney, Agent, or Firm* — Ohlandt, Greeley, Ruggiero and Perle, L.L.P.

(57) ABSTRACT

There is provided a game in which a first game piece has a first game piece level value, a second game piece has a second game piece level value, and a third game piece has a third game piece level value. The first game piece also has an attacking ability value such that the first game piece, when within an attacking range with respect to the second and third game pieces (i) is permitted to concurrently attack both of the second and third game pieces if a total of the second and third game piece level values is less than or equal to the attacking ability value, and (ii) is not permitted to concurrently attack both of the second and third game pieces if a total of the second and third game piece level values is greater than the attacking ability value.

3 Claims, 8 Drawing Sheets

U.S. PATENT DOCUMENTS

| | | | | |
|---|---|---|---|---|
| 5,201,525 | A | 4/1993 | Castro | 273/293 |
| 5,221,091 | A | 6/1993 | Gallegos et al. | 273/247 |
| 5,435,568 | A | 7/1995 | Black | 273/303 |
| 5,467,997 | A | 11/1995 | Bashirzadeh | 273/302 |
| 5,662,332 | A | 9/1997 | Garfield | 273/308 |
| 5,810,666 | A | 9/1998 | Mero et al. | 463/41 |
| 5,951,013 | A | 9/1999 | Campanella | 273/308 |
| 5,954,332 | A | 9/1999 | Mero et al. | 273/236 |
| 6,200,216 | B1 | 3/2001 | Peppel | 463/1 |
| 6,254,099 | B1 | 7/2001 | Pederson | 273/292 |
| 6,322,077 | B1 * | 11/2001 | Braunlich et al. | 273/292 |
| 6,375,566 | B1 | 4/2002 | Yamada | 463/1 |
| 6,435,508 | B1 * | 8/2002 | Tavel | 273/292 |
| 6,481,714 | B1 | 11/2002 | Jacobs | 273/236 |
| 6,554,702 | B2 | 4/2003 | Mahar et al. | 463/11 |
| 6,561,513 | B1 * | 5/2003 | DeGeorge | 273/262 |
| 6,601,851 | B1 | 8/2003 | Sakamoto et al. | 273/308 |
| 6,626,434 | B2 | 9/2003 | Tanaka | 273/292 |
| 6,666,770 | B1 | 12/2003 | Kubo et al. | 463/43 |
| 6,808,172 | B2 | 10/2004 | Bedford et al. | 273/255 |
| 6,893,021 | B1 | 5/2005 | Gress | 273/298 |
| 6,938,898 | B2 | 9/2005 | Merritt, III | 273/236 |
| 7,108,604 | B2 | 9/2006 | Kameta et al. | 463/31 |
| 7,118,107 | B2 | 10/2006 | Niedner et al. | 273/236 |
| 7,144,013 | B2 | 12/2006 | Tanaka | 273/308 |
| 7,258,343 | B2 | 8/2007 | Hayakawa et al. | 273/308 |
| 7,309,288 | B2 | 12/2007 | Machida | 463/43 |
| 7,314,407 | B1 | 1/2008 | Pearson | 463/7 |
| 7,371,165 | B2 | 5/2008 | Reizei et al. | 463/11 |
| 7,452,279 | B2 | 11/2008 | Yamashita | 463/43 |
| 7,469,901 | B1 | 12/2008 | Hilliard | 273/308 |
| 2002/0043764 | A1 | 4/2002 | Imhof | 273/292 |
| 2003/0188465 | A1 | 10/2003 | Ruiz | 40/124.9 |
| 2005/0082751 | A1 | 4/2005 | Wittig | 273/243 |
| 2006/0033273 | A1 | 2/2006 | Borne et al. | 273/243 |
| 2006/0038349 | A1 * | 2/2006 | Meeks | 273/308 |
| 2006/0202423 | A1 | 9/2006 | Tanaka | 273/292 |
| 2006/0220317 | A1 | 10/2006 | Edwards | 273/292 |
| 2006/0284373 | A1 | 12/2006 | Kenney et al. | 273/149 R |
| 2008/0099990 | A1 | 5/2008 | Wittig | 273/243 |

OTHER PUBLICATIONS

International Search Report mailed Oct. 24, 2005 in Int'l Application No. PCT/US04/35345.

Scarne, John. "*Encyclopedia of Games*," Harper & Row Publishers, 1973, pp. 359-361.

Ferretti, Fred. "*The Great American Book of Sidewalk, Stoop, Dirt, Curb, and Alley Games*," Workman Publishing Company, New York, Sep. 1975, pp. 86-91.

Official Risk Board Game Rules (1993) published by Parker Brothers on or before Dec. 31, 1993; retrieved from http://www.wizards.com/common/instruct/risk.pdf on Jun. 10, 2011, pp. 1-16.

*Risk Global Domination*, article by Gamespot, retrieved from http://www.gamespot.com/ps2/strategy/risk/news/6090078/risk-global-domination-company-line?tag=updates%Btitle%3B1,2 pages.

Official Axis and Allies Pacific Game Rules (2000), published by Avalone Hill on or before Dec. 31, 2000, retrieved from http://www.wizards.com/default.asp?x=ah/faqs/axispacific on Jun. 10, 2011, pp. 1-36.

* cited by examiner

300

ROLE-PLAYING GAME

CROSS-REFERENCE TO RELATED APPLICATIONS

The present application is a continuation of U.S. patent application Ser. No. 12/717,382, filed Mar. 4, 2010, which is a continuation of U.S. patent application Ser. No. 11/974,800, filed Oct. 16, 2007, which claims the benefit of U.S. Provisional Patent Application No. 60/829,746, filed Oct. 17, 2006.

BACKGROUND OF THE INVENTION

1. Field of the Invention

The present disclosure relates to role-playing games, and more particularly, a role-playing game that provides players with ways to select and arrange an assortment of game pieces for play.

2. Description of the Related Art

Role-playing games (RPGs) are well-known in the field of gaming. A player of an RPG assumes the role of one or more characters, and then populates various fantasy scenarios with the one or more characters. Though popular, RPGs often have constraints that players find limiting, or that add very little strategic texture to gameplay. Conventional RPGs are often designed for play by strictly advanced, or by strictly novice players; or may have an overabundance of constraints on placement of gamepieces on a playing surface and so forth.

Conventional RPGs constrain players, for example, to games between a limited number of opponents; or to commencement of play with equal numbers of gamepieces; or to assuming the roles of characters having limited versatility during gameplay; or to playing in a game environment that is immutable across instances of gameplay. A character of limited versatility might, for example, only be able to carry out one particular maneuver during a turn of play; or might have a limited repertoire of available actions; or might have characteristics not amenable to modification once play has commenced.

Accordingly, there is a need for a game that provides players with a unique set of scenarios and experiences each time the game is played. There is also a need for a game that provides elements of flexibility and versatility to free players from the constraints imposed by conventional RPGs, and that provides accessible gameplay to players across many skill levels.

SUMMARY OF THE INVENTION

The present disclosure provides for a game. The game includes a plurality of game pieces, each of which has a game piece level value. Each time the game is played, players select a game level value. Players select a set of game pieces for play, such that a total of game piece level values in the set is less than or equal to the game level value.

In an embodiment, the game piece values are different for different game pieces.

In an embodiment, the members of the set of game pieces selected for play by a player have different functions in the game.

In an embodiment, the game provides a plurality of game pieces. The plurality of game pieces contains subsets that have a function in the game that can be utilized only when all subset member game pieces are held by a single player.

In an embodiment, the game provides a game area that has spaces on which game pieces are placed. The game has a first game piece having a first game piece level value, a second game piece having a second game piece level value, and a third game piece having a third game piece level value. The first game piece has an attacking range that indicates a maximum quantity of the spaces over which the first game piece can attack another game piece during a turn of play, and has an attacking ability value. The first game piece is permitted to concurrently attack the second and third game pieces if (a) the second and third game pieces are within the attacking range, and (b) a total of the second and third game piece level values is less than the attacking ability value.

In an embodiment, the game provides a game area with spaces that can be occupied by a game piece. A game piece in this embodiment has a movement value that indicates a maximum number of game area spaces the game piece is allowed to traverse during a round of play.

In an embodiment, the game includes a game area having spaces in a multi-dimensional configuration that includes a first direction, a second direction, a third direction, and a fourth direction. During a turn of play, a game piece is permitted to be moved along the spaces in a sequence of steps that includes a first step in said first direction and a second step in said second direction. A game piece is permitted to retrace its steps during a turn of play.

In an embodiment, there is provided a game having a plurality of cards, a game area, and a number-generating device. Each of the plurality of cards has a card level value. The game area has spaces on which cards are arranged during play. The number-generating device provides a numerical value with some element of chance. The game is played with a game level value. A player selects for play a subset of the number of cards, such that the sum of card level values of the selected cards is less than the game level value. The plurality of cards includes a first card having a first card level value, a second card having a second card level value, and a third card having a third card level value. The first card has (a) an attacking range that indicates a maximum quantity of spaces over which the first card can attack another card during a turn of play, (b) an attacking ability value, and (c) a characteristic that is modified based on a numeric value provided by the number-generating device. The first card is permitted to concurrently attack both of the second and third cards if (i) the second and third cards are within the attacking range of the first card, and (ii) a total of the second and third card level values is less than or equal to the attacking ability value.

There is also provided a storage medium having stored thereon machine-readable instructions which, when executed by a processor, instantiate a human-playable version of the game.

DESCRIPTION OF THE INVENTION

Figure 1:
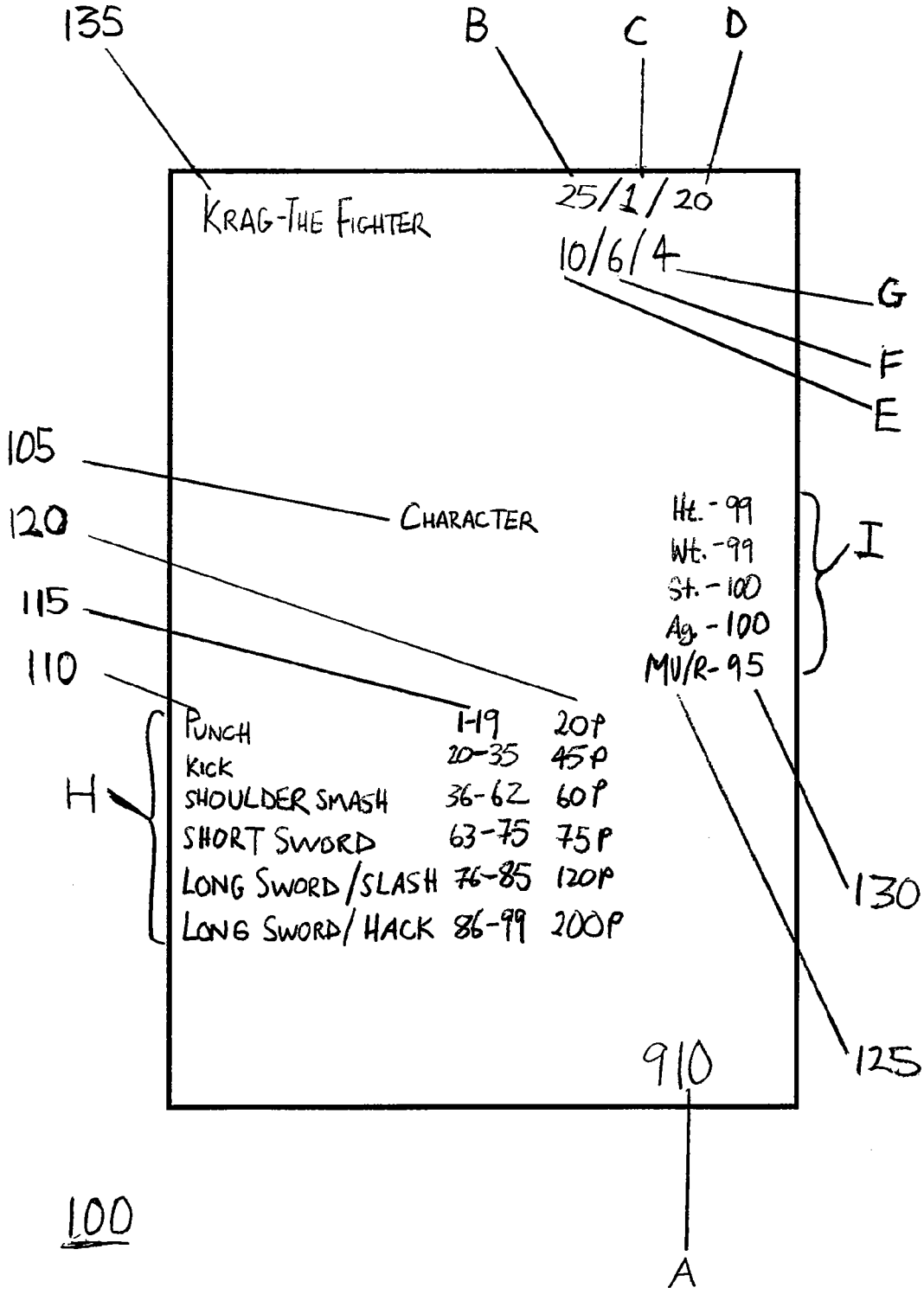
FIG. 1 is an illustration of a game piece.

FIG. 1 is an illustration of a game piece 100 of a game. Game piece 100 represents a character 105 of the game. Although FIG. 1 shows character 105 by the test string "CHARACTER", character 105 may be artistically depicted on game piece 100. Various tokens are suitable for use as a game piece 100, including cards.

Game piece 100 displays a combat abolishment points ("CAP") number A for character 105. CAP number A represents an amount of damage, injury, and the like that character 105 may absorb before being removed from play. Game pieces lacking a CAP number cannot be destroyed and removed from play. If, for example, CAP number A represents a zero or negative value, then character 105 will be removed from play. Predetermined rules of play govern how CAP number A can be incremented or decremented as a game progresses.

Game piece 100 provides a level number B for character 105. To play the game, the players agree upon a level value for the game, i.e., a game level value. Thereafter, each player selects a combination of game pieces 100 such that level numbers B of the selected game pieces 100 total less than or equal to game level value.

Each game piece 100 has a function in the game. Such functions include, for example, character abilities, defense, modification of a character's abilities, or terrain. A game piece that modifies a character's abilities is termed an artifact card. Typically, a player will select a plurality of game pieces 100 that have different functions, e.g., a first game piece having a first function and a second game piece having a second function, in accordance with a strategy that the player wishes to employ during the game.

Game piece 100 provides a dimensions code C that indicates an amount of space taken up by character 105 on a game surface such as game area 300 (described below). Dimensions code C may contain a first numeral, a second numeral, and a third numeral. If dimensions code C contains only the first numeral, character 105 is assumed to have a width (in units of measure, (see FIG. 3, space 315)) equal to the first numeral, a length of one unit, and a height of an indeterminate (i.e., irrelevant) number of units. If dimensions code C contains only the first and the second numeral, character 105 is assumed to have a width, in units, equal to the first numeral, a length, in units, equal to the second numeral, and a height of an indeterminate (i.e., irrelevant) number of units. If dimensions code C contains the first, second, and third numerals, then character 105 is assumed to have a width, length, and height, in units of measure, equal to these three numerals, respectively.

Game piece 100 provides a multiple attack code D that conveys information about an ability of character 105 to attack other game entities. If, according to predetermined rules of play, character 105 is allowed to attack more than one game entity during a turn of play (a "multiple attack"), then character 105 can attack entities targeted in such multiple attack if the value of multiple attack code D greater than or equal to a sum of level numbers B for all of the targeted entities. For example, if character 105's attack code D is 100 then character 105 is deemed able to concurrently attack a first entity having a level code of 75, and a second entity having a level code of 25, because 75+25=100. If character 105's attack code D is 90, then character 105 would be deemed unable to concurrently attack a first entity having a level code of 75 and a second entity having a level code of 25, because 75+25>90. Rather, character 105 would be constrained to attack either the first or second entity singly, since, in attacks other than a multiple attack, attack code D is deemed irrelevant.

Game piece 100 provides a non-attacking movement code E that conveys information about an ability of character 105 to move while not performing an attack. During a turn of play, character 105 is able to move a number of units of measure (see FIG. 3, spaces 315) less than or equal to that provided by non-attacking movement code E.

Game piece 100 provides an attacking movement code F that conveys information about an ability of character 105 to move while performing an attack. During a turn of play, where the turn includes an attack, character 105 is able to move a number of units of measure less than or equal to that provided by attacking movement code F.

Game piece 100 provides an attacking distance code G that conveys information about an ability of character 105 to cover distance while attacking during a turn of play. Attacking distance code G is measured in the same units of measure used for other movements of character 105, and is less than or equal to attacking movement code F.

Game piece 100 provides an attack matrix H that conveys information about offensive maneuvers usable by character 105 against another entity. Each line of attack matrix H includes an attack name 110, an attack probability 115, and an attack damage 120. Attack name 110 is a descriptive name for an offensive action, such as "kick." Attack probability 115 is a numerical range between a first value and a second value. In an embodiment, attack probability 115 is unique and non-overlapping for each attack name 110. A player of the game who wishes to cause character 105 to launch an attack will use a number-generating device that provides a numeric value with some degree of chance, to generate a third value, where the third value will be within an attack probability 115 for an attack name 110. For example, with a conventional die having six sides, there is a one in six chance that a particular side will be facing up. Thus a particular offensive maneuver is selected. Upon successful use of the offensive maneuver (i.e., attack name 110) an intended victim, which could be another instantiation of a character 105, for example, will have its CAP number A decremented by an amount based upon attack damage 120 for the particular attack name 110 used. Several number-generating devices are suitable for this application, including, but not limited to, a die; a computer hardware-based pseudorandom number generator (PRNG), or a software-based PRNG. In an embodiment, the game provides a number generating device.

Game piece 100 provides a character rating matrix I that conveys information about various characteristics of character 105, including a quality 125 and a rating 130. In an embodiment, rating 130 is a numerical value, though other ways of denoting a rating are possible. Each quality 125 is appropriate to what sort of entity character 105 is taken to represent. For example, if character 105 is a spacecraft, then one appropriate quality 125 would be a denotation of crew-members. If character 105 is a person, then one appropriate quality 125 would be intelligence. Quality 125 can be used to modify members of a character 105's attack matrix H. For example a character 105's quality 125 (say, agility) could modify attack matrix H member "punch."

Game piece 100 provides a character name 135 for character 105. In an embodiment, character name 135 is unique across all game pieces 100 used for game play.

Some game pieces provide a function in the game only when held by a player in conjunction with another game piece. Description of such game pieces is made with reference to FIGS. 2 and 2A.

Figure 2:
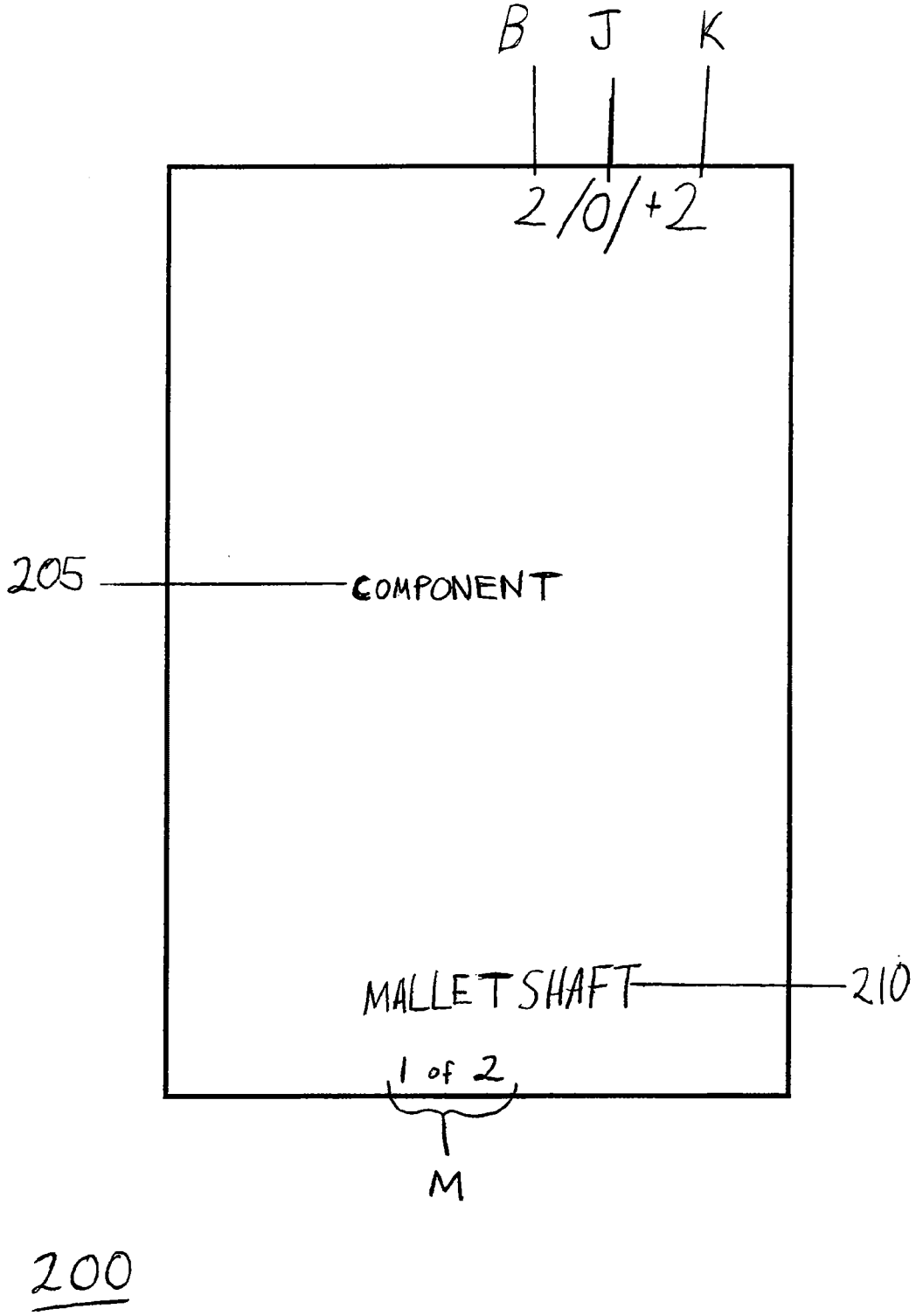
FIG. 2 is an illustration of a game piece.

FIG. 2 is an illustration of a game piece 200. Game piece 200 features a game piece name 210, a component 205, and a subset index M. Subset index M is a player's cue that another game piece 200, i.e., a member of a particular set described by subset index M, is necessary for a particular in-game utility to be available to the player. If game piece 200 is a card with a subset index M, it is known as a subset card. Game piece name 210 provides a player with a descriptor of a function that game piece 200, when held properly, provides. In an embodiment, component 205 is an artistic rendition of the (part) function that game piece 200 represents, for example, a handle of a weapon.

Game piece 200 provides a level number B (as described in FIG. 1), an attack roll modifier J, and an attack damage modifier K. Attack roll modifier J and attack damage modifier K are used by a player during gameplay to modify, for example, characteristics of an attack by a particular character 105 described on a game piece 100 held by the player when the player has assembled each game piece 200 that is a member of a particular subset index M.

Figure 2A:
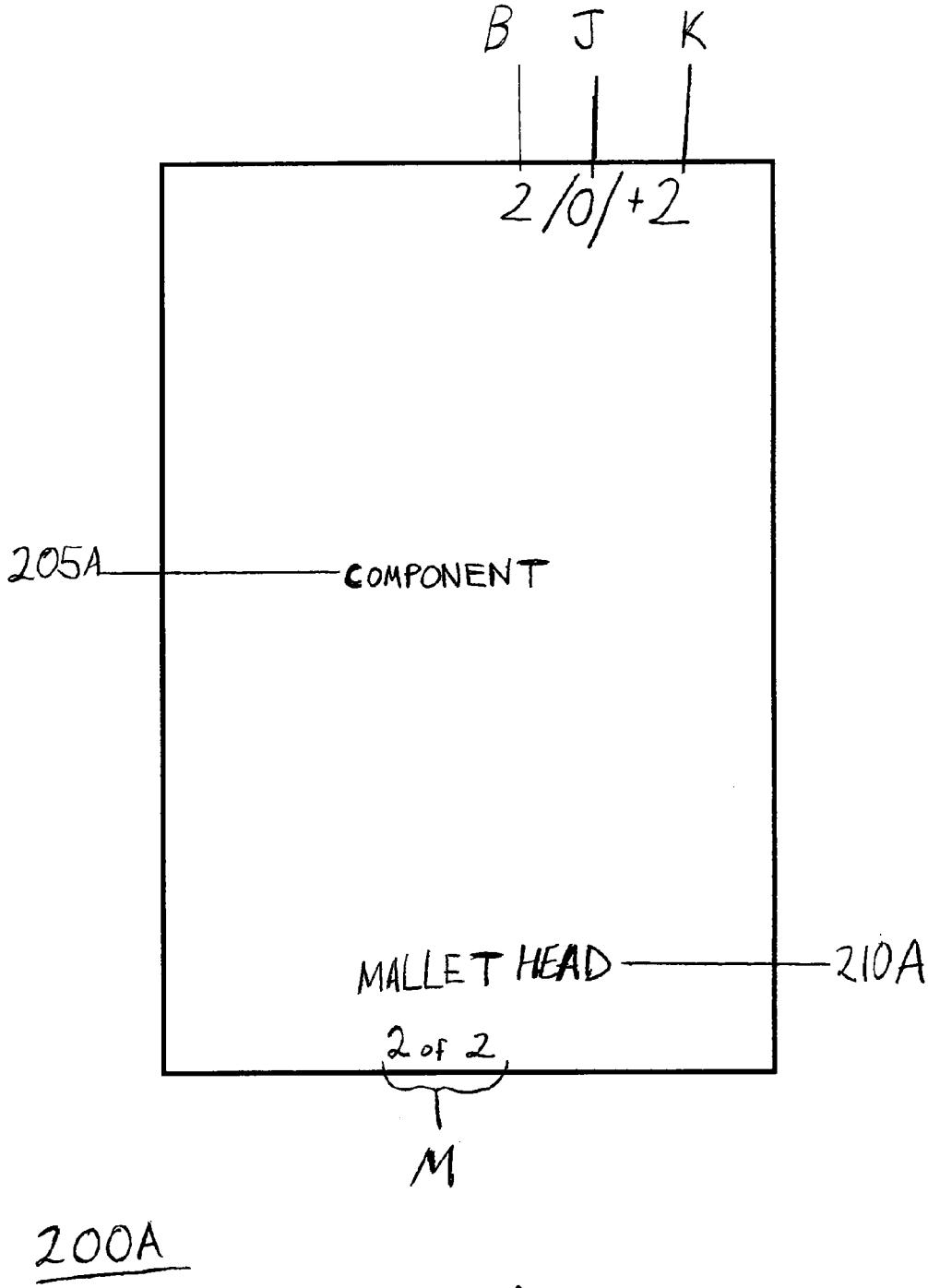
FIG. 2*a* is an illustration of a game piece.

FIG. 2A is an illustration of a game piece 200A. Game piece 200A provides a component 205A, a game piece name 210A, and a value of subset index M that are analogous to, but identical to, component 205, game piece name 210, and subset index M of game piece 200. Otherwise, game pieces 200 and 200A are homologous.

FIGS. 2 and 2A here are collectively an illustration of a set of two subset cards, each of which does not individually have game function, from which a player can fashion a mallet having function in the game.

Figure 3:
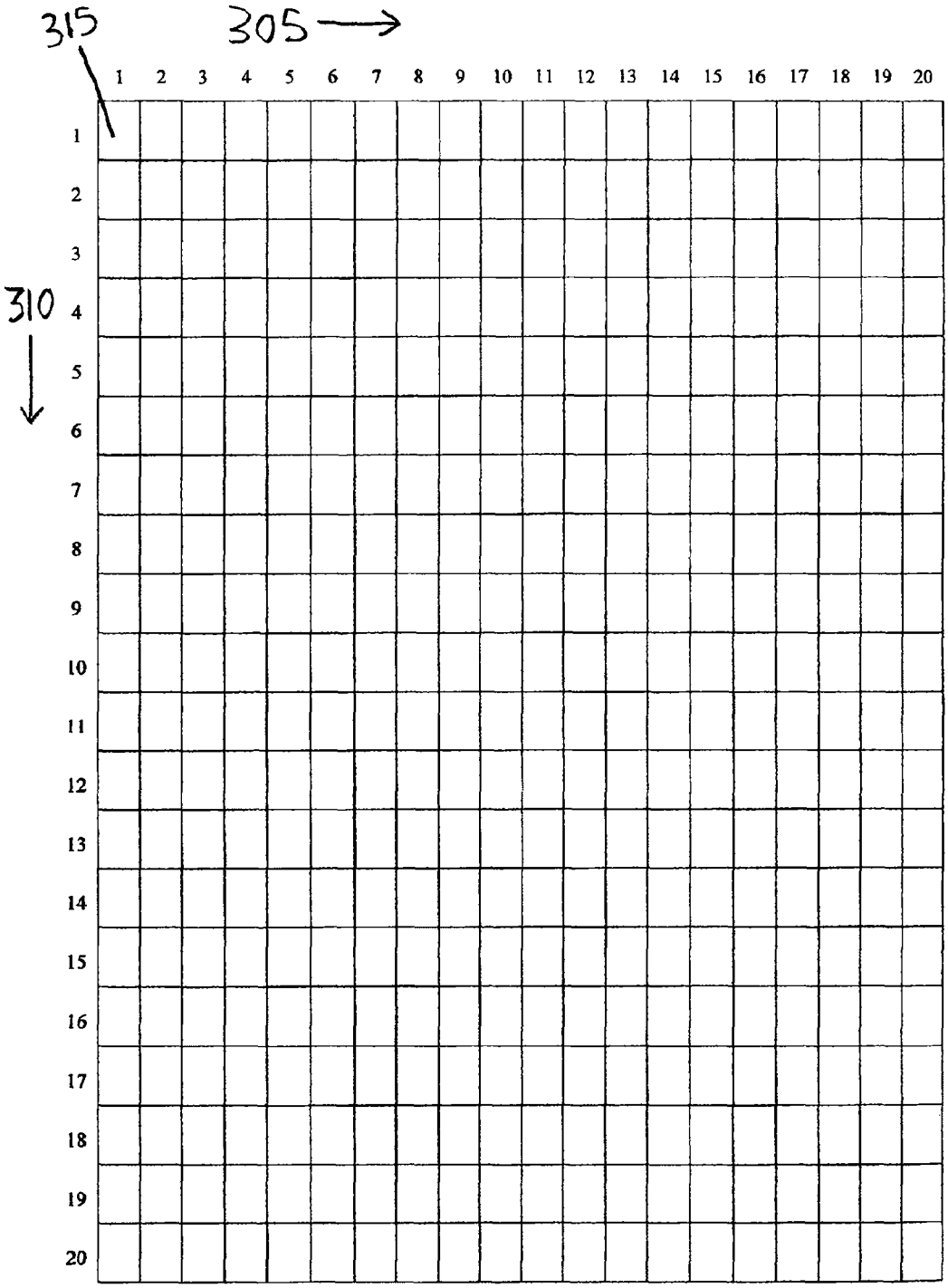
FIG. 3 is an illustration of a game area.

FIG. 3 is an illustration of a game area 300. Game area 300 includes spaces 315, in a multi-dimensional configuration, in this case a two-dimensional configuration, that includes a direction 305 and a direction 310. Although FIG. 3 shows game areas 300 as a two-dimensional configuration of spaces 315, game area 300 could be configured with three or more dimensions. Each space 315 is fixed at a discrete location in each of direction 305 and direction 315. Game pieces 100 occupy spaces 315 during play, and may be moved from one space 315 to a next space 315 in a variety of directions, according to, for example, movement code E, attacking movement code F, or attacking distance code G. Game piece 100 is permitted to be moved along spaces 315 in a sequence of steps that includes a first step in direction 305 and a second step in direction 315.

Figure 4:
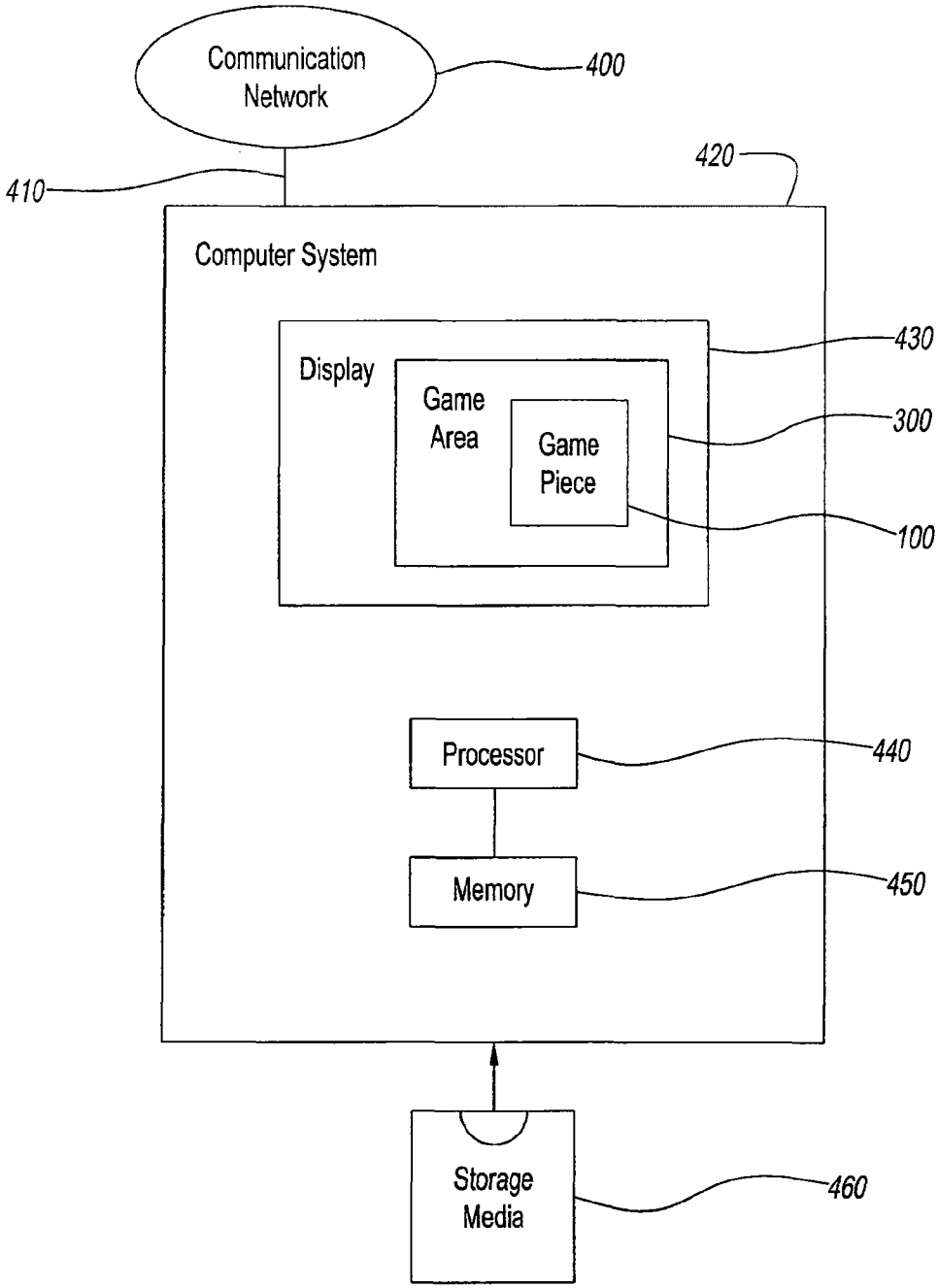
FIG. 4 is a block diagram of a computer system and communication network.

FIG. 4 is a block diagram of an embodiment of the game played on a computer system 420. Computer system 420 connects to a communication network 400 via a data link 410. Data link 410 could be, for example, a wireless or wired link such as ethernet, a digital subscriber line, or a radio. Communication network 400 could be, for example, the Internet, an intranet, an extranet, a cellular phone network, or a plain old telephone system (POTS) network. Many computer systems 420 may connect to communication network 400.

Computer system 420 includes a display 430, a processor 440, a memory 450. Memory 450 contains instructions that control processor 440, and cause processor 440 to instantiate a game environment. Display 430 displays, to a user of computer 420 (i.e., a player of the game), a representation of game area 300 and a plurality of game pieces 100.

Although in FIG. 4 the instructions to instantiate the game are shown as residing in memory 450, the instructions could be tangibly embodied as a computer-readable program on a storage media 460 for subsequent installation into memory 450. Storage media 460 can be any conventional storage media such as a magnetic tape, an optical storage media, a compact disk, or a floppy disk. Alternatively, storage media 460 can be a random access memory, or other type of electronic storage, located on a remote storage system.

Figure 5:
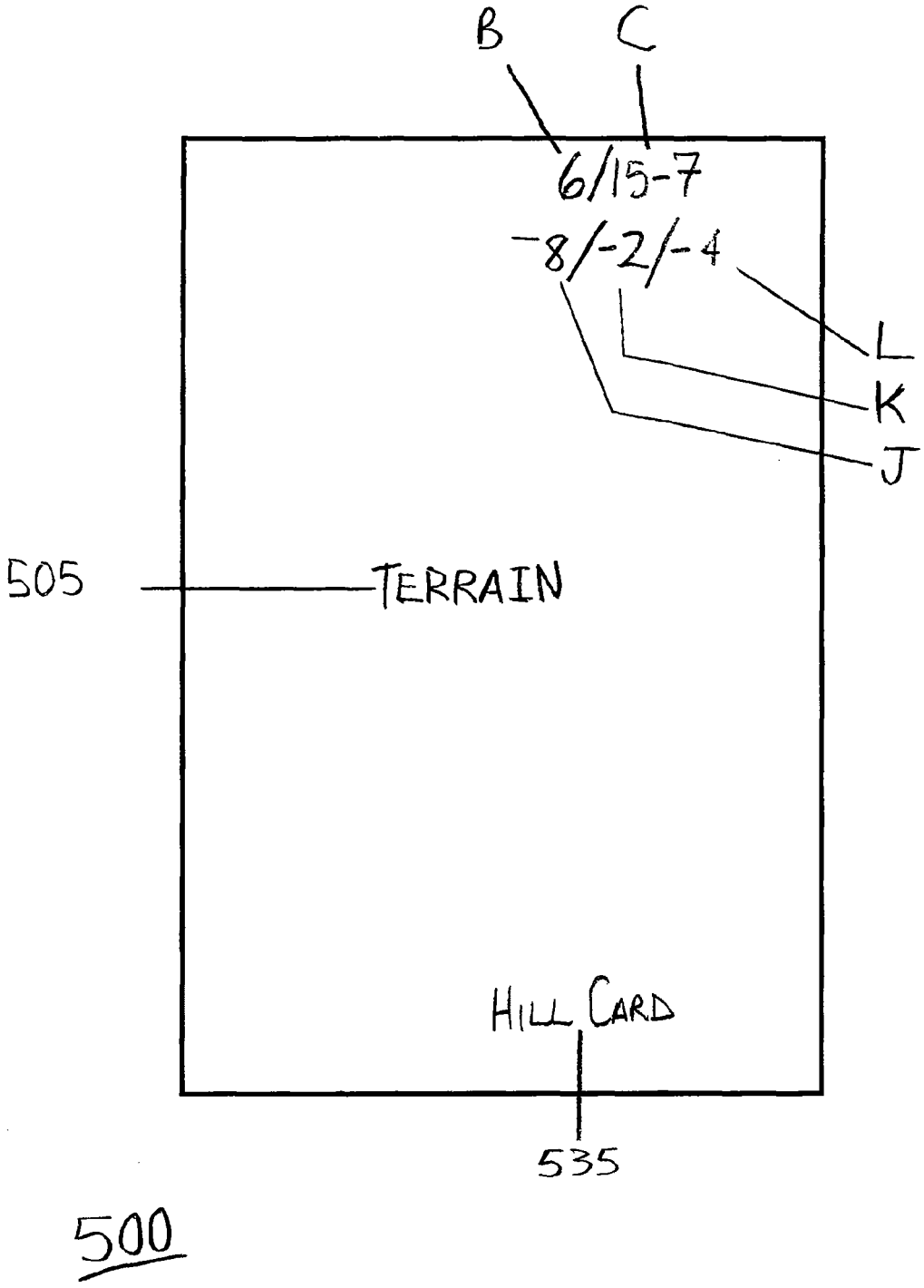
FIG. 5 is an illustration of a game piece.

FIG. 5 is an illustration of a game piece 500. Game piece 500 provides a terrain type 505 and a card name 535. Game piece 500 contains a level number B, a dimensions code C, an intruder attack roll modifier J, an intruder attack damage modifier K, and an intruder movement modifier L. Terrain type 505 may be depicted as an artistic rendering of a particular kind of terrain, e.g., an artistic rendering of a hillock. Modifiers J, K, and L are not limited to modification of intruders. Modifiers J, K, and L are described in further detail below.

Figure 6:
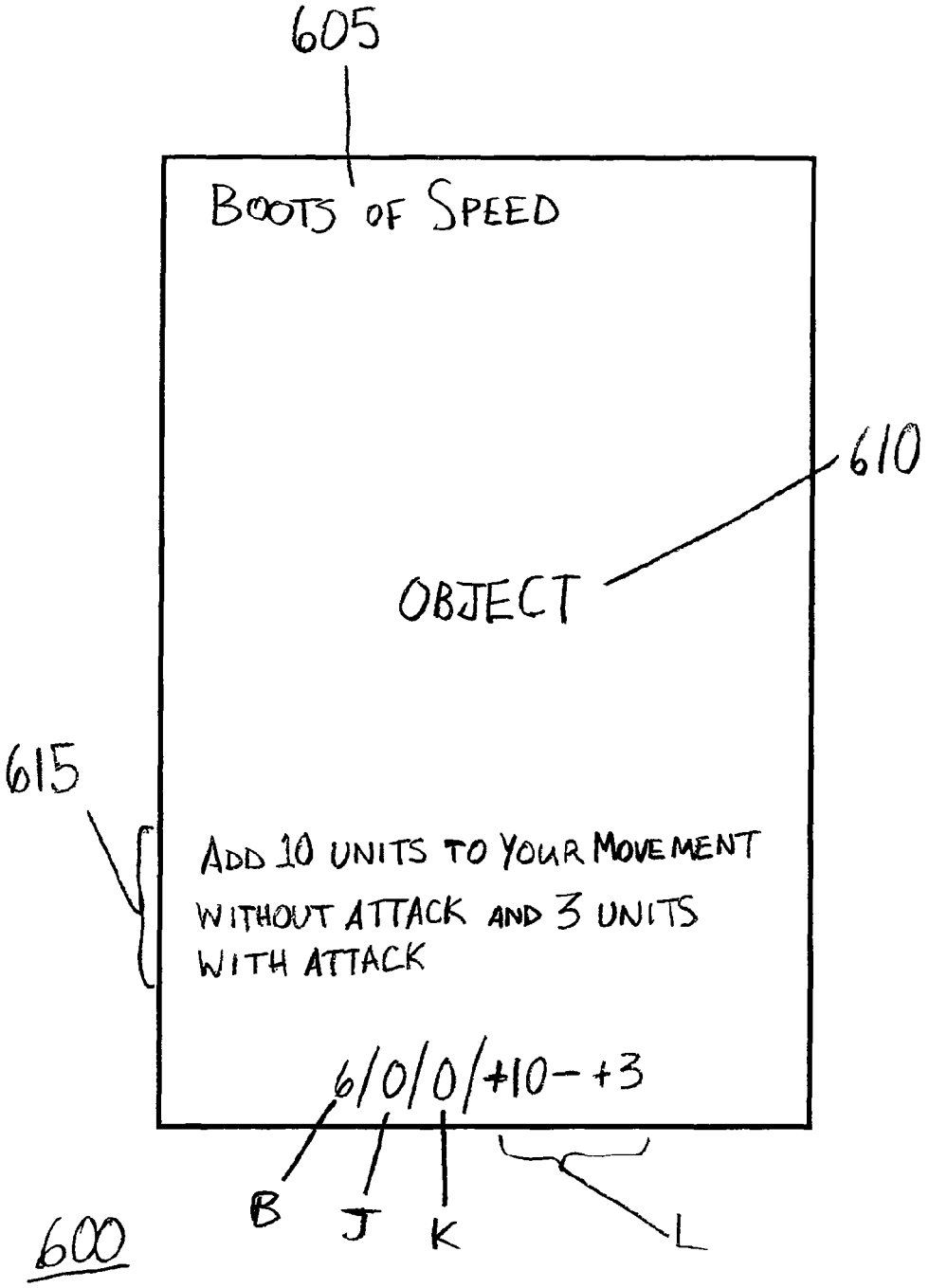
FIG. 6 is an illustration of a gamepiece.

FIG. 6 illustrates a game piece 600, which is a so-called modification card. Modification cards have an effect of imposing a benefit or hindrance on other game pieces in the game. Game piece 600 includes a card name 605, a modifier object type 610, and a legend 615. Modifier object type 610 may be depicted as an artistic rendering of a particular kind of object, e.g., a rendering of magical boots. Legend 615 informs a player how to make use of game piece 600 during play. Game piece 600, being of modification card type, includes necessarily level number B. Modifiers J, K, and L are as described elsewhere and take particular meaning according to the game piece type being modified by game piece 600.

Figure 7:
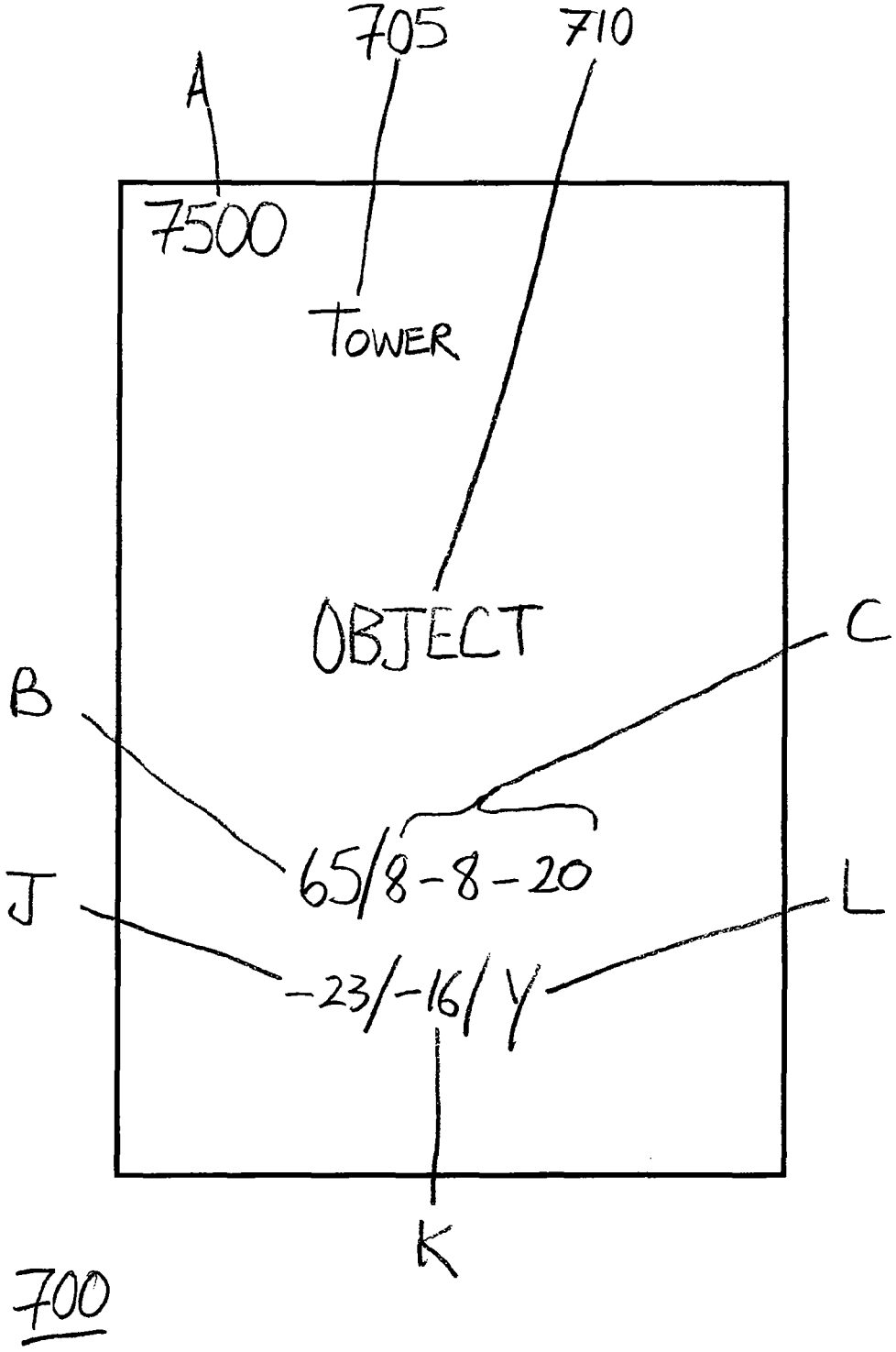
FIG. 7 is an illustration of a gamepiece.

FIG. 7 illustrates a game piece 700, which is a so-called defense card. Defenses include things like towers, fortifications, and the like. Being a defense card, game piece 700 has a CAP number A as described for FIG. 1. Game piece 700 has also a level number B, and a dimension code C, as described previously. An intruder attack roll modifier J, an intruder attack damage modifier K, and an intruder movement modifier L are as described below in the section "how to read a defense card."

The tools and or pieces of the game include, but are not limited to, playing cards, a grid to scale, models, tiles and, gemstones.

The cards to be used include, but are not limited to, spaceships, people, armors, weapons, planes, different terrains (rocks, hedges, moats, rivers, hills, lakes, and the like), towers, castles, walls, creatures, monsters, warriors, battleships, troops of different nature, rank and abilities (pike men, infantry, archers, snipers, swordsmen, artillery, captains, generals, and the like), modification cards and subset cards. Subset cards are cards that are combined to build something. An example of subset cards is: a Mallet Shaft, a Mallet Head, Mallet Head Rings (to keep the mallet head from splitting) and a Mallet Gemstone assemble into making a magical mallet weapon. That is, the members of a set of subset cards can be assembled into a greater whole. Subset cards only affect one character at a time and only benefit a character that has the ability to use them. For example, it is of no use for Krag—The Fighter (FIG. 1, character 105) to build a magical mallet weapon because he does not have the ability to wield it as established by the indicia on his card.

Six basic categories of cards include, but are not limited to: character (monsters, ships, warriors, and the like), defensive (walls, gates, towers (see FIG. 7) and the like), terrain (hills (see FIG. 5), rocks, trees, rivers and the like), artifacts (weapons, gems, armors, and the like) and modification (Gauntlets of Attack—add 5 to your attack rolls, Boots of Speed—add 10 to your movement capability (see FIG. 6)) and subset cards. These cards shall be explained in more detail in Appendix A.

Movement can add a crucial strategic aspect to the game, therefore, it could use, but is not essential, a scaled area. The recommended game area is a grid with equally spaced, parallel vertical and horizontal lines, such as game area 300, and thus includes many spaces 315 rectangular in shape. And each line will represent a measure of movement and distance, which include, but are not limited to, one foot, one yard, one nautical mile, or one parsec.

Characters such as ships, men, warriors, and the like. are placed on the squares according to their size. For example, Krag—The Fighter (see FIG. 1) would occupy 1 square, while Horned Dragon (see FIG. 8) occupies 2 squares wide and 3 squares long. Then movement must be possible for their size and they are allowed to move to any adjacent square, including diagonal squares, for however far their indicia allow (including any modification). A diagonal move counts as 1.5 moves; so a character must have the ability to move at least 2 squares to make 1 diagonal move, 3 squares to make 2 diagonal moves and so on. Characters are allowed to change direction during the same movement phase (Refer to Appendix A—Section C).

Tiles are pieces that represent anything off the game area. When a character, item and the like, cannot be accurately represented by a single tile, these may be combined for this purpose.

The gemstones can have numbers engraved on them to represent the number of characters, ships, or whatever they are representing off the game area. For example, four identical archers would be represented by one gemstone with a four engraved on it.

A model is a miniature representation of itself and it will represent, but not limited to, a tree, a hill, a river, a creature, a monster, a weapon, a spaceship, a battleship, and/or an army.

Playing the Game

The Game will usually begin with all players agreeing to the maximum number of levels they can expend. Levels are stated on each card, for example level number B (FIG. 1). For example, players agree to use 50 levels each. They then expend up to their 50 levels in any variation. A player may choose to use the cards: Krag—The Fighter (25 levels), Hill (6 levels), Large Rock (4 levels) and the subset cards of Mallet Shaft (2 levels), Mallet Head (3 levels), Mallet Head Rings (1 level), Mallet Gemstone (8 levels) and Weapon Gemstone (1 level) to utilize his allotted 50 levels. Another alternative could be to use his cards: Krag—The Fighter (25 levels), Horned Dragon (21 levels), and Large Rock (4 levels). In some circumstances, players may choose to expend less than their agreed upon levels, a) because they can not combine their cards to use up all their allotted 50 levels or b) because they feel they can develop a better strategy using less than the maximum allotted 50 levels. An example would be to use 49 levels using the cards: Horned Dragon (21 levels), Mageron—The Magician (24 levels), and Large Rock (4 levels) or any other combination of cards adding up to less than the 50 allotted levels.

The next customary step is to agree on all limitations, penalties and variations that will be applied for the game.

Indicia on terrain cards, only benefit the character of the player that controls that terrain and hinder an intruder. Control of terrain is established by the first player to occupy that terrain when no other player is in that terrain. A player occupies terrain when his character 105 is deemed to occupy the same space 315 already deemed occupied by terrain. Thus the player of character 105 can be said to be associated with the terrain. An intruder is a character entering a controlled terrain or defense.

Only cards with CAP number A (see FIG. 1 and Appendix A, Section A) and fashioned tools can be withdrawn from the game. When a card does not have CAP, it can not be destroyed and is considered an extension of the character. An example of an extension to a character is: an armor card that modifies an attacker's roll by −6. The armor does not need to be destroyed before the character is attacked. A character wearing armor simply benefits from it. When a card has CAP, it can be destroyed. An example of a card that can be destroyed, like fashioned tools, is: a tower, a wall, a bridge and the like . . . . Cards that have CAP can be attacked and destroyed and therefore removed from the game. However, a player may attack his opponent's characters controlling a tower instead of attacking the tower itself, so that he can utilize that tower after defeating them.

When a character is on top of an object, such as a tower, a wall and the like, and that object is destroyed, the character's present CAP is reduced by half for every ten units he falls. Let's say Krag—The Fighter is on top of a 10 unit wall and after being attacked for a few turns, his present CAP is 600. When that wall is destroyed and he falls, his CAP becomes 300 (600×0.5=300). If it was a 20 unit wall that was destroyed, his CAP would become 150 (600×0.5=300 for the first 10 units, and 300×0.5=150 for the second 10 units) and so on. Any time there is a fraction the number is rounded down.

Healers and the Process of Healing:

Clerics, Medics, Corpsman, Healers and etc. are character that can heal or rejuvenate other characters and/or themselves. There are multiple ways of healing, for example: laying on of hands, prayers, magic, use of science, hospitals. There are also healing artifacts like: roots, mushrooms, potions, orbs, vaccines, medicine, scrolls, and the like. When a player decides that one of his characters 105 is going to heal another one he must observe certain conditions: a) he must follow the indicia on the character's card; b) his character must be within healing distance, which for all characters that heal non magically, is next to the character to be healed and c) the player knows that the action of healing takes the entire turn of the character during his turn. There are some characters that can heal and fight. The indicium used to indicate the character's healing ability is: H1, H2, H3, etc. . . . This ability is used by a player rolling his percentile dice and multiplying that number by the level of the character divided by the number following the "H". For example, a player is using an H1 tenth level cleric to heal another character; the player rolls percentile dice and gets a 50, this means: 50 (roll of dice) multiply by 10 (10/1 cleric's healing level) is 500, i.e., this cleric healed 500 points of damage. If the player was using an H2 tenth level cleric and we follow the same example, the equation would be: 50 (roll of dice) multiply by 5 (10/2 cleric's healing level) is 250. This H2 tenth level cleric would heal 250 points of damage. And if the player was using an H3 tenth level cleric, with the same roll of dice, that cleric would be able to heal 150 points of damage, this is 50 (roll of dice) multiply by 3 (10/3 cleric's healing level because he is an H3 and because all fractions are rounded down as previously established). A player can only heal a character to its original CAP; all excess healing points are nullified. If a character is to drink a potion or etc. to heal himself, this action also takes his entire turn, including movement. Hospitals, healing centers, churches, etc. will be laid out like terrain cards, and will have healing indicia upon them.

The order of play can be decided in different ways (such as a roll of dice, a random card drawn) and at different junctures in the pre-engagement process. The junctures include, but are not limited to: before the maximum agreed upon level number is determined, after maximum agreed upon level number is determined, or after the players have completed laying out their game area with their weapons, armies, and the like.

The game area can be divided into equal parts (but this is not a necessity). Before the combat phase begins, each players' area should be concealed from the other players to keep secret their personal strategic lay out. Players should agree to a time limit to build up their areas. Then players can layout their chosen cards however they see fit within their allotted area. When a player builds a castle, a fort, a wall that encloses an area and the like, he must include a gate.

Use of Gemstones and Tiles:

If a player is using one or more stealth, hidden characters and/or if the play area does not allow all the cards to be laid out comprehensively, he can use a colored gem and/or tile to designate the stealth item or items, stealth character or characters, hidden character or characters and/or the closely assembled army or armies. If the reason for the use of a gem and/or tile is stealth, then the player puts a gem or tile at the proper place within the game area for its position designation and puts an identical one on top of his stealth character or characters and/or item or items' card or cards, which he places face down outside the game area. If a player is using gemstones or tiles because his cards can not physically fit in the area where the armies, weapons and the like. are to be placed, then he puts the gemstones or tiles in those areas within the game area and places the identical corresponding gemstones or tiles on his cards which are face up and therefore visible for his opponent or opponents to view.

Determining if your opponent is using stealth character or characters is easy. If you agree to use 200 levels and you see your opponent has used only 150, he is probably using 50 levels of one or more stealth characters and/or traps. However, you will not know what character or characters and/or item or items he is using stealthily or where they are located. Upon identification from another player by whatever means used (i.e., magical scrying, vision, attack from the stealth character or characters, and the like) the player then turns over his card or cards for that character or characters and/or item or items to be identified. When one or more cards are to be detected by only one opponent, then they are only revealed to him. When one or more hidden characters move away from behind wherever they are hiding and are in a line of detection from an opponent, the gem or tile is removed and the character or characters cards are disclosed.

After all placements, the game will commence according to the order of play. On a player's turn, he utilizes all of his cards, one at a time, which may include non action taken by one or all of his cards. Action taken by a player will be according to his character's abilities (movement, fighting, stealth, defensive and the like) and/or limitations (weapons, subset cards, monsters, etc.) which are established by the indicia on each card. This aspect of the game will become clearer upon examination of the Appendix A.

Stealth and/or invisible characters are innately so, and this will be stated by the indicia on the card.

A Player's Turn:

A player's turn incorporates movement, action and/or inaction. These must be according to the character's abilities as indicated by the indicia on the card. A player must declare the path and distance of a character's movement by stating so prior to moving the character. When a player decides to move a character, he does not have to move it the entire allotted distance on the card. For instance, a player can move Krag—The Fighter only two spaces instead of the 10 spaced allotted to that character. A player goes through all of his cards, and again, this may include non action. An example of non action: a player has a character hiding behind a rock, he does not wish to move that character and take the chance of being identify. So, he leaves that character alone for that turn.

During a player's turn, it is possible for another player to take action. An example of a player performing action when it is not his turn is when an opposing player activates a trap of his. For example: a player declares he will move his Krag—The Fighter character four units forward, and after two units of movement he steps on a hidden trap. The player who has laid the hidden trap must stop the player in turn the instant he activates the trap. The result of the trap will be determined by the indicia on that particular trap card. If the player's in turn character has not been destroyed or limited in his movement by the trap card, he must continue along his original action, and continue to move Krag—The Fighter four spaces forward from his original position. When a player has completed using all of his cards, he states that his turn is over and the next player, according to the original order of play, now takes his turn.

Location of a trap can be designated by the stealth method of putting a gem and/or tile on the game grid and putting an identical one on the trap card which is face down. When this method is used, a player attacking the gem and/or tile, thinking it is a character instead of a trap, activates it, even though he did not step on it. Location of a trap can also be designated by the concealed method, which is when a player writes down where the trap is to be laid upon the game area. He conceals the location information from his opponents until the trap is activated, then turns over his trap card and the written location, and performs the action according to the indicia on it. Some traps are good for only one use, while others may be permanent. When a trap is permanent, it must be concealed again in the same location, and it is up to the opponents to remember where the trap is located. Traps may be deactivated by just about any character. A trap is deactivated by a player stating that the action of one or more of his characters' turns, during his turn, will attempt to deactivate it. For a character to deactivate a trap, it must be located within his striking distance (refer to Appendix A, Section G) and the roll of dice must be equal to or less than the character's agility rating number (stated by the indicia on the card). In ship version, the rating number used is the maneuverability rating number. When a character is unsuccessful deactivating a trap, the player who owns the trap will roll his dice. If the roll is 25 or less, nothing happens. But, if the roll is 26 or greater, the character has set off the trap while trying to disarm it and takes full damage; there is no modification to this roll, or to the damage produced by the trap. All other characters within the range of the trap, will take damage accordingly (including modifications). Certain characters (such as a rogue or a magician) will have a greater chance to deactivate a trap due to their innate greater agility rating number.

A player is eliminated from play when all of his character cards have been removed from the game (refer to Appendix A, Section A). The game is over when a player, during his turn, eliminates his final opponent. He is then declared the winner and keeps all the cards used in the game.

Stalemate:

A stalemate does occur when there are two players left in the game and one or both are down to one character card. When neither of them can eliminate the other within twenty turns each, a stalemate is declared. In a stalemate, the last two players divide the cards by level or a random shuffle-and-deal method. Alternatively, stalemated players may keep the cards with which they began play, and divide among them the cards lost by eliminated players. When there are more than two players at the start of the game, the cards lost by the eliminated players are divided among the final two players. When there are two players at the start of the game, the players keep the original cards they had at the beginning of the game. Ordinarily, the winner of a game is awarded all the cards.

Variations of Play

A variation of play is to utilize a character's Magic Use/Resistance rating number. When a character is being attacked by magic, the player gets to throw his dice and if his roll is equal to or less than the Magic Use/Resistance rating number of the character being attacked, then that character takes only half damage from the attack. This same rule can apply for spaceships. When being attacked, the spaceship would make his damage reduction roll using his Shield Technology rating number.

Another variation is that the winner of the game does not keep all the cards.

Another variation when playing a battleship or spaceship version; players divide the total amount of damage the ship can absorb before being destroyed among the two sides of the battleship or the four sides of force fields protecting a spaceship. For example, if you look at the spaceship card, you will see that the ship can endure 1100 points of damage before destruction. Players can divide those 1100 points among the forward, back and side force fields in whatever denominations they desire (250, 250, 250, and 250 or 400, 300, 250 and 150, etc.) in essence lowering the amount of damage the ship can absorb before destruction. When using this method a player must also divide his weaponry. A player who keeps all his weapons on one side of the ship does 100% damage (i.e., Tractor Beam—30 p), when chooses to have his weapons facing fore and aft, does half damage (i.e., Tractor Beam—15 p), when on 3 sides does ⅓ damage (i.e., Tractor Beam—10 p), and on all 4 sides does one-quarter damage (i.e., Tractor Beam—7 p, because when any fraction is left over, in this case 7.5, the damage number is rounded down). When this method is used, players must write down their intended alterations. It adds an extra aspect of strategy because the ship must maneuver an oncoming attack to a shield that can absorb the attack. This aspect will also limit the ships ability for counter attack. Let's say a ships forward shield is gone, so the player maneuvers the ship to face away from the attack. That ship does not have any aft facing weaponry and therefore can not return fire. It can only absorb the attack, which may be advantageous because it distracts the attacking ship from doing something else. When playing the battle ship version, the ship's ability to endure damage would be divided in half to symbolize the vulnerability of the two sides of the ship.

Another variation is for a player to state all movements at the beginning of his turn.

Another variation is that players physically move their characters along the path and distance chosen. But when a character is critically wounded by a trap or something else, the player may not wish to continue to move it along its originally intended path, that is why, it is highly recommended to use the vocal method before moving a character.

Another variation is for a character's CAP to be reduced by one half no matter how far he falls.

Another variation of play is to employ spying devices. Spying devises can be, but are not limited to, probes, spies, satellites, traitors, and the like . . . .

Spying devices, spies and/or traitors—the allowance of some or all of these cards and any limitations to them must be agreed prior to game play. Spying devices, spies, and/or traitors are to be placed most commonly, after all players have laid out their own game area. These cards are also most commonly placed in an opponent's area, although this is not a necessity because some spying devices, spies and/or traitors have the ability to move, and players can move them around stealthily from their own area. To place these cards, each player will take a turn while all other players turn their backs or leave the room (but is not a necessity). The order in which these cards are placed is the same as the order of play (when players are turning their backs). Another time when a player can take action when it is not his turn is when he activates or utilizes one or more of his spies and/or traitors.

Another variation is all characters are stealthily concealed until revealed by detection (refer to Detection of a Character).

Another variation of play is that Rogues automatically disarm traps (refer to the last paragraph on page 5 that continues to page 6).

Another variation is that Rogues add 10 (or an agreed upon amount) points or an agreed upon number to their agility when disarming traps.

Another variation of play is that a move from one square to another square counts as one unit of movement regardless if it is a diagonal move.

Another variation is that all characters, monsters, ships and the like. are just one square in size. However, terrain cards must remain their indicated size and occupy the corresponding space as indicated by their indicia.

Another variation is that terrain cards' size can be distributed however a player desires. In the case of a Hill card which is 15 squares wide and 7 squares long, occupying a total of 105 squares, players can distribute those 105 squares however they see fit, most commonly connected.

Another variation is that when a player needs to build something, say a ladder or a raft, he may do so, but only if he has access to the material or materials he needs, in this case, wood or trees. To build something requires 3 entire turns of a character. Other than with subset cards, a player is never allowed to build anything offensive or defensive, such as catapults, clubs, cannons, quarterstaffs, trenches, moats, and the like . . . . The amount of points of damage a fashioned tool can absorb before it is destroyed is equal to ten times the level of the character building it multiplied by the level of the material. For instance, a ladder built by a 25th level character with a 1st level tree will withstand 250 (25×10×1=250) points of damage before being destroyed, whereas a 10th level character will build a ladder that will withstand 100 (10×10×1=100) points of damage before being destroyed and so on. A player can use two trees to build one ladder that can withstand twice the damage. A one level tree can construct ten units of ladder. A two level tree would build a 20 unit ladder; a three level tree would build a 30 unit ladder and so on. Players can also use two one level trees to build a 20 unit ladder. In addition, a player can use two one level trees to build a 10 unit ladder that would withstand twice the damage before destruction.

Another Variation is that an item made from a complete set of Subset cards enhances a character's abilities regardless of whether he does or does not possess the ability to use it. For example, Krag—The Fighter builds a magical mallet with the Subset cards: Mallet Shaft, Mallet Head, Mallet Head Rings and Mallet Gemstone. He then benefits from a +4 to all of his attack rolls and a +9 to all his damage inflictions.

Detection of a Stealth Character

A stealth or invisible character, monster, ship, and the like. must move and act according to the card's (including all modifications) indicia. A player can not say, for example: 'my stealth ninja just killed your magician'. So, when a player is using a stealth character he must write down that character's starting point, which must be in the player's starting area. In the stealth version of play, the methods for detecting a stealth character, ship, monster and the like. are, but limited to:

Line of sight—the recommended line of sight is 50 units on the game grid; however, the players may agree to any standard they choose. Line of sight may also be enhanced through the use of cards like the Tower, the Flare, the Telescope and the like . . . . A Tower card will raise the viewer to a higher vantage point possibly allowing him to see further and better, as designated by the indicia on the card, ergo, giving that character a better chance to see stealth characters. A Flare card illuminates the surroundings according to the indicia on the card. A Telescope card allows a character to see greater distances and more accurately according to the indicia on the card.

Scrying—the magical viewing of a distant area. A player declares that one of his magical characters (wizard, witch, sorceress, magician or etc.) will attempt to scrye. A scrye attempt uses a character's entire turn. To successfully scrye, the player must roll a number equal to, or less than, his character's Magic Use/Magic Resistance rating number (stated by the indicia on the card and all modifications). When this roll is successful all characters out the line of site and/or hidden are revealed. The player then has the possibility to reveal stealth characters by rolling his dice again. If the second roll's number (including modifications) is greater than the agility rating number (including modifications) of a stealth character within the scryed area, he is revealed. When a player rolls a 99 for the second scrying roll, all characters are revealed regardless of their agility rating number.

Attacking—when a player attacks using a stealth or hidden character, monster, ship and the like, then that character, monster, ship and the like. is disclosed, unless that character, monster, ship and the like. is cloaked and/or innately invisible. When cloaked or innately invisible, the attacker or attackers' presence is known, but not their specific identity. The reduction of attacking ability against an invisible or cloaked character or object is minus ten to the attack roll, unless otherwise stated by the indicia on the card of the invisible and/or cloaked character or characters.

Activating a trap—a stealth and/or invisible character activates a trap the same as a non stealth and/or invisible character by, but not limited to, stepping on it (a land mine, for example), coming within its range (proximity device), touching it (opening a door), falling into it (a pit), and the like.

Detection—when a player declares he will use a character's action to try to detect one or more stealth characters; he forfeits all other action (including movement) by that character on that turn only. The player then rolls his dice. The number rolled must be greater than the final stealth number (which is the character's agility rating number including all modifications). When a player rolls 99, all stealth characters and/or traps are disclosed within his detection area, regardless of all modifications.

Detection area includes, but is not limited to, the character's line of sight, scrying area, touch, sensor range and the like.

Communication—A player can communicate information to another player. For example, Player B reveals a trap to Player A only. Player A decides it is in his best interest to communicate that information to Player C. To communicate this information, Player A must have a communication line available to Player C. This is accomplished by, but not limited to, space communication, radio communication, hand gestures, verbally, and the like. Let's say Player A is going to gesture to Player C the information, his and Player C's characters must be within view of each other. To communicate, a character uses its entire action for that turn, but, communication is unlimited during the turn. Meaning, a player can play telephone with all the characters that have not taken action on that turn, which increases the range of the information being transmitted.

When a player divulges information illegally, he is penalized. The penalty includes, but is not limited to, losing the rest of his turn, losing his next turn, the removal of one of his characters (chosen by the player whose information should have remained secret).

Appendix A

How to Read a Character Card

FIG. 1, indicium A states the CAP number of the character. CAP stands for Combat Abolishment Points. When a character has his CAP number depleted to zero or less, it is removed from the game.

FIG. 1, indicium B states the level number of the character. An example on how to use this number would be: two players agree on using 100 levels. A player uses his Mageron card. Mageron is level 24 and will use 24 of the player's allotted 100 levels, leaving him 76 levels to utilize however he plans.

FIG. 1, indicium C states the dimensions of the character. The first number is the width of the character, the second number is the length of the character, and the third number is its height. When there is only one number for FIG. 1, indicium C, this number indicates the character's width, its length is always 1 and its height is considered irrelevant. When there are two numbers for FIG. 1, indicium C, the first number is width, the second number is length and its height is considered irrelevant. When there are three numbers for FIG. 1, indicium C, the first number is width, the second is length and the third number is height, as stated earlier.

Some characters are allowed multiple attacks during their turn. A multiple attack is when a character attacks more than one character, at a time. FIG. 1, indicium D states the total levels that a character can attack during his turn. i.e., Krag—The Fighter's D number is 20. This means he can attack as many characters as long as the sum of their levels does not exceed 20. D does not apply when in single attack mode. Any character can attack another character regardless of their levels.

FIG. 1, indicium E states the maximum units of movement the character can utilize when he is not attacking, during a turn.

FIG. 1, indicium F states the maximum units of movement the character can utilize when he is attacking, during a turn.

FIG. 1, indicium G states the maximum units of attacking distance of the character during a turn. A unit of attacking distance is equal to a unit of movement.

FIG. 1, indicium H states: 1) the different types of attack the character can perform 2) the range of numbers for each particular attack and 3) the reduction of CAP to one or more of his opponents related to each particular attack.

FIG. 1, indicia I state the character's ratings. The ratings have the abbreviations: H, for Height; W, for Weight; S, for Strength; A, for Agility; MU/R, for Magic Use and/or Resistance; Sp, for Speed; Ar, for Armament; C, for Crew; M, for Maneuverability; Sh, for Shield Technology How to Read a Terrain Card:

FIG. 5, indicium B states the level number of the terrain. An example on how to use this number would be: two players agree on using 100 levels. A player uses his Hill card. Hill is level 15 and will use 15 of the player's allotted 100 levels, leaving him 85 levels to utilize however he plans.

FIG. 1, indicium C states the dimensions of the terrain. The first number is the width of the terrain, the second number is the length of the terrain and the third number is the height of the terrain. When there is one number for FIG. 1, indicium C, the terrain's length is always 1 and its height is considered irrelevant. When there are two numbers for FIG. 1, indicium C, the first number is width, the second number is length and its height is considered irrelevant. And when there are three numbers for FIG. 1, indicium C, the first number is width, the second is length and the third number is height, as stated earlier. When you look at the Hill card (FIG. 5), you will see that FIG. 5, indicium C is 15-7. This means, the Hill is 15 squares wide, 7 squares long, and height is irrelevant.

FIG. 5, indicium J states the modification to an intruder's attack roll.

FIG. 5, indicium K states the modification to an intruder's attacking damage.

FIG. 5, indicium L states the modification to an intruder or intruders' movement upon entering the terrain unless the intruder or intruders have the ability to fly over or pass under the terrain. Such a modification to movement could also affect the character of a player who placed the terrain in play. An X designates a terrain that is inhospitable and therefore a character must move around it. A Y designates a terrain that is impassable unless the character is aided or has the ability to fly over or pass under it.

How to Read a Defense Card

FIG. 7, indicium A states the CAP number of the Defense card. CAP stands for Combat Abolishment Points. When a Defense card has its CAP number depleted to zero or less, it is removed from the game.

FIG. 7, indicium B states the level number of a Defense card. An example on how to use this number would be: two players agree on using 100 levels. A player uses his Tower card. Tower is level 65 and will use 65 of the player's allotted 100 levels, leaving him 35 levels to utilize however he plans.

FIG. 7, indicium C states the dimensions of the defense area. The first number is the width of the defense area, the second number is the length of the defense area and the third number is the height of the defense area. When there is one number for FIG. 7, indicium C, the defense area's length is always 1 and its height is considered irrelevant. When there are two numbers for FIG. 7, indicium C, the first number is width, the second number is length and its height is considered irrelevant. And when there are three numbers for FIG. 7, indicium C, the first number is width, the second is length and the third number is height, as stated earlier. When you look at the Tower card, (FIG. 7) you will see that indicium C is 8-8-20. This means, the Tower is 8 squares wide, 8 squares long and 20 squares high.

FIG. 7, indicium J states the modification to an intruder's attack roll.

FIG. 7, indicium K states the modification to an intruder's attack damage.

FIG. 7, indicium L states the modification to an intruder's movement upon entering this defense area unless an intruder and/or intruders have the ability to fly over or pass under a defense area. Such a modification to movement could also affect the character of a player who placed the terrain in play. An X designates a defense area that is inhospitable and therefore a character must move around it. A Y designates a defense area that is impassable unless the character is aided or has the ability to fly over or pass under it.

How to Read a Subset Card

Subset cards are to be combined to build an item. An incomplete set is not allowed to be used. The set must be complete in order for the Subset cards to be utilized. A player will know by the indicia on each subset card a) how many subset cards are needed to complete a particular set (FIG. 1, indicium M), b) the maximum number he is allowed to add or subtract to his attack roll (FIG. 1, indicium J) and c) the additional damage he inflicts upon his opponents while employing the weapon (FIG. 1, indicium K).

Each subset card's abilities are added so that when completed, the item or etc. has the abilities of all of its parts. For example, Section J of the cards: Mallet Shaft, Mallet Head, Mallet Head Rings and Mallet Gemstone reads: 0, 0, 0 and 4, respectively. These numbers are added so that when the Magical Mallet is completed, it will give the bearer up to plus or minus 4 for all his attack rolls. To clarify, a player in this situation can add or subtract up to 4 to his attack roll so that the new number falls within the range he needs to use the Magical Mallet. And on the cards of: Mallet Shaft, Mallet Head, Mallet Head Rings and Mallet Gemstone, Section K reads: +2, +6, +0, and +1, respectively, giving the holder a +9 to the damage he inflicts to his opponents while employing this weapon. The indicia of the subset card are explained below.

FIG. 1, indicium B states the level number of the Subset card. An example on how to use this number would be: two players agree on using 100 levels. A player uses his Magical Mallet complete subset cards set. Magical Mallet complete set uses 14 levels and therefore will use 14 of the player's allotted 100 levels, leaving him 86 levels to utilize however he plans.

FIG. 1, indicium J states the maximum number a player can add or subtract to his attack roll when the set is complete.

FIG. 1, indicium K states the number a player will add to his attack damage when the set is complete.

FIG. 1, indicium M states how many subset cards are needed to complete a set and what part of the set that particular card is.

How to Read an Artifact Card

An Artifact card is an item that helps or hurts a character's performance. An Artifact card can have up to four numbers or (FIG. 6, indicia: B, J, K, and L) explained below. When there is: only one number on it, it is FIG. 6, indicium B, when there are two numbers, the first number is FIG. 6, indicium B and the second one is FIG. 6, indicium J, when there are 3 numbers, the first one is FIG. 6, indicium B, the second one is FIG. 6, indicium J and the third one is FIG. 6, indicium K and when there are four numbers, the first one is FIG. 6, indicium B, the second one is FIG. 6, indicium J, the third one is FIG. 6, indicium K and the fourth one is FIG. 6, indicium L.

FIG. 6, indicium B states the level number of the Artifact card. An example on how to use this number would be: two players agree on using 100 levels. A player uses his Long Sword card. Long Sword is level 2 and will use 2 of the player's allotted 100 levels, leaving him 98 levels to utilize however he plans.

FIG. 6, indicium J states the maximum number a player can add or subtract to his attack roll, when there is not a plus or minus sign in front of the number. When there is a plus or minus sign in front of the number the player must add or subtract, depending on the sign, the number stated in Section J.

FIG. 6, indicium K states the number a player adds or subtracts, depending on the sign, to his attack damage against his opponent or opponents.

FIG. 6, indicium L states the number that a player adds or subtracts to his character's movement ability. This Section can have up to two numbers. When there is only one number in this section, the modification applies to movement with and without attack. When there are two numbers, the first number modifies movement without attack and the second number modifies movement with attack.

How to Read a Modification Card

A Modification card states the benefit or hindrance it performs. All modification cards have a Section B. Other Sections A-M may or may not appear on the cards. If other sections appear on a Modification card, it is aligned and read according to the category it falls within. Meaning, when the Modification card modifies a defense area, the Sections are aligned and read like a Defense card, when the Modification card modifies an artifact, the Sections are aligned and read like an Artifact card and so on.

The techniques described herein are exemplary, and should not be construed as implying any particular limitation on the present disclosure. It should be understood that various alternatives, combinations and modifications could be devised by those skilled in the art. The present disclosure is intended to embrace all such alternatives, modifications and variances that fall within the scope of the appended claims.

What is claimed is:

1. A non-transitory storage medium having a program encoded thereon in machine-readable format, wherein said program is executed by a processor and causes said processor to carry out a method having the steps of:

instantiating a game comprising:

a game area having a multi-dimensional configuration of spaces;

a first game piece having a first game piece level value;

a second game piece having a second game piece level value; and a third game piece having a third game piece level value; and placing said game pieces into play in said game, wherein said first game piece has:

(a) an attacking range that indicates a maximum quantity of said spaces over which said first game piece can attack another game piece during a turn of play, and (b) an attacking ability value, wherein said first game piece, when within said attacking range with respect to said second and third game pieces:

(i) is permitted to concurrently attack both of said second and third game pieces if a total of said second and third game piece level values is less than or equal to said attacking ability value, and (ii) is not permitted to concurrently attack both of said second and third game pieces if a total of said second and third game piece level values is greater than said attacking ability value.

2. A system comprising:

a processor; and a memory that contains instructions that when executed by said processor, cause said processor to:

instantiate a game comprising:

a game area having a multi-dimensional configuration of spaces;

a first game piece having a first game piece level value;

a second game piece having a second game piece level value; and a third game piece having a third game piece level value; and place said game pieces into play in said game, wherein said first game piece has:

(a) an attacking range that indicates a maximum quantity of said spaces over which said first game piece can attack another game piece during a turn of play, and (b) an attacking ability value, wherein said first game piece, when within said attacking range with respect to said second and third game pieces:

(i) is permitted to concurrently attack both of said second and third game pieces if a total of said second and third game piece level values is less than or equal to said attacking ability value, and (ii) is not permitted to concurrently attack both of said second and third game pieces if a total of said second and third game piece level values is greater than said attacking ability value.

3. A method of playing a game having (i) a plurality of game pieces, wherein said game pieces each have a game piece level value, and (ii) a game area having a multi-dimensional configuration of spaces, wherein said method comprises:

instantiating said game, using a processor;

placing into play in said game a first game piece having a first game piece level value, a second game piece having a second game piece level value, and a third game piece having a third game piece level value, wherein said first game piece has:

(a) an attacking range that indicates a maximum quantity of said spaces over which said first game piece can attack another game piece during a turn of play, and (b) an attacking ability value, wherein said first game piece, when within said attacking range with respect to said second and third game pieces:

(i) is permitted to concurrently attack both of said second and third game pieces if a total of said second and third game piece level values is less than or equal to said attacking ability value, and (ii) is not permitted to concurrently attack both of said second and third game pieces if a total of said second and third game piece level values is greater than said attacking ability value.

* * * * *